US005588749A

United States Patent [19]

Ishikawa

[11] Patent Number: 5,588,749

[45] Date of Patent: Dec. 31, 1996

[54] MULTIFUNCTIONAL BAG

[75] Inventor: Hiromi Ishikawa, Tokyo, Japan

[73] Assignee: Office Ishikawa Co., Ltd., Tokyo, Japan

[21] Appl. No.: 412,884

[22] Filed: Mar. 29, 1995

[30] Foreign Application Priority Data

Apr. 6, 1994 [JP] Japan ..... 6-004704

[51] Int. Cl.[6] ..... B65D 30/10; B65D 33/10; A41D 3/08; A41D 15/04

[52] U.S. Cl. ..... 383/4; 2/69.5; 2/84

[58] Field of Search ..... 383/4; 2/69.5, 2/84; 190/1

[56] References Cited

U.S. PATENT DOCUMENTS

| | | | |
|---|---|---|---|
| 1,254,124 | 1/1918 | Converse | 2/69.5 |
| 2,442,105 | 5/1948 | Vacheron | 383/4 |
| 2,462,269 | 2/1949 | Krempel | 2/84 |
| 2,536,169 | 1/1951 | Gray | 383/4 |
| 3,143,748 | 8/1964 | Manning | 383/4 |
| 3,228,034 | 1/1966 | Grove | 2/69.5 |
| 3,489,194 | 1/1970 | Hoover | 190/1 |
| 3,763,972 | 10/1973 | Karzmar | 383/4 |
| 3,879,775 | 4/1975 | Iwata | 383/4 |
| 4,060,852 | 12/1977 | Meeks | 2/84 |
| 4,138,742 | 2/1979 | Meeks | 2/84 |
| 4,190,918 | 3/1980 | Harvell | 383/4 |
| 4,604,765 | 8/1986 | Schultz | 383/4 |
| 4,671,393 | 6/1987 | Rainey | 190/1 |
| 4,723,300 | 2/1988 | Aranow | 190/1 |
| 4,863,003 | 9/1989 | Carter | 383/4 |
| 5,110,219 | 5/1992 | Lopes | 383/4 |

FOREIGN PATENT DOCUMENTS

| | | | |
|---|---|---|---|
| 1324314 | 3/1963 | France | 2/84 |

*Primary Examiner*—Stephen P. Garbe
*Attorney, Agent, or Firm*—Wenderoth, Lind & Ponack

[57] ABSTRACT

A multifunctional bag device according to this invention can be used not only as an ordinary bag, but also to provide a variety of functions by itself or with a sheet and hood contained in the bag. The multifunctional bag device of this invention includes a bag 1 consisting of right and left bag members 1*a*, 1*b* that is designed to contain appropriate things in it, a single sheet 2 which is contained in the bag 1 in a folded state, and a hood 3 formed so that it can be loaded on the upper portion of the sheet via fasteners. The bag 1 has handles 6 at the top, and edges of the right and left bag members are connected to each other at the bottom 4, and with a fastener 5 or other opening/closing device which allows the right and left bag members to be unfolded. The sheet 2 is equipped with a fastener 7 or other opening/closing device at peripheral edges to allow a bag 8 to be formed by folding the single sheet in half. With this configuration, the multifunctional bag 1 is a novel bag that can be used not only as an ordinary bag, but also as a pair of seats, a cushion, a lap robe, a sleeping bag, and a hooded poncho.

10 Claims, 4 Drawing Sheets

MULTIFUNCTIONAL BAG

BACKGROUND OF THE INVENTION

1. Field of the Invention

The present invention relates generally to a bag having multiple functions, and in more detail, it relates to a bag having multiple functions which can be used not only as an ordinary bag, but also to provide a variety of functions by itself or with a sheet and hood contained in the bag.

2. Prior Art

Up to now, a variety of bags, such as those for shopping, have been produced. However, these bags are designed to be used as a single-function unit.

Therefore, it has been a general fixed idea that a variety of bags are required for accommodating various things suited to the size or type of the particular bag.

SUMMARY OF THE INVENTION

Having been developed in consideration of the above-stated situation, this invention intends to do away with the fixed idea that a variety of different bags are necessary, and to offer a multifunctional bag that can be used not only as an ordinary bag, but also to provide a variety of functions by itself or with a sheet and hood contained in the bag.

The multifunctional bag of this invention includes a bag 1 consisting of right and left bag members designed to contain appropriate things therein, a single sheet 2 contained in the bag 1 in a folded state, and a hood 3 formed so that it can be loaded or mounted on the upper portion of the sheet 2. The bag 1 has handles 6 at the top of each bag member, and edges of the right and left bag members are connected to each other at the bottom 4. A fastener 5 or other opening/closing device is provided along the remaining edges (i.e. other than the bottom) to allow the right and left bag members to be unfolded while being connected to each other at the bottom edges of the right and left members. The sheet 2 is equipped with a fastener 7 or other opening/closing device at peripheral edges to allow a bag 8 to be formed by folding the single sheet 2 in half. With this configuration, the bag 1 can realize a novel bag that can be used not only as an ordinary bag, but also as a pair of seats, a cushion, a lap robe, a sleeping bag, and a hooded poncho.

DETAILED DESCRIPTION OF THE INVENTION

Figure 1:
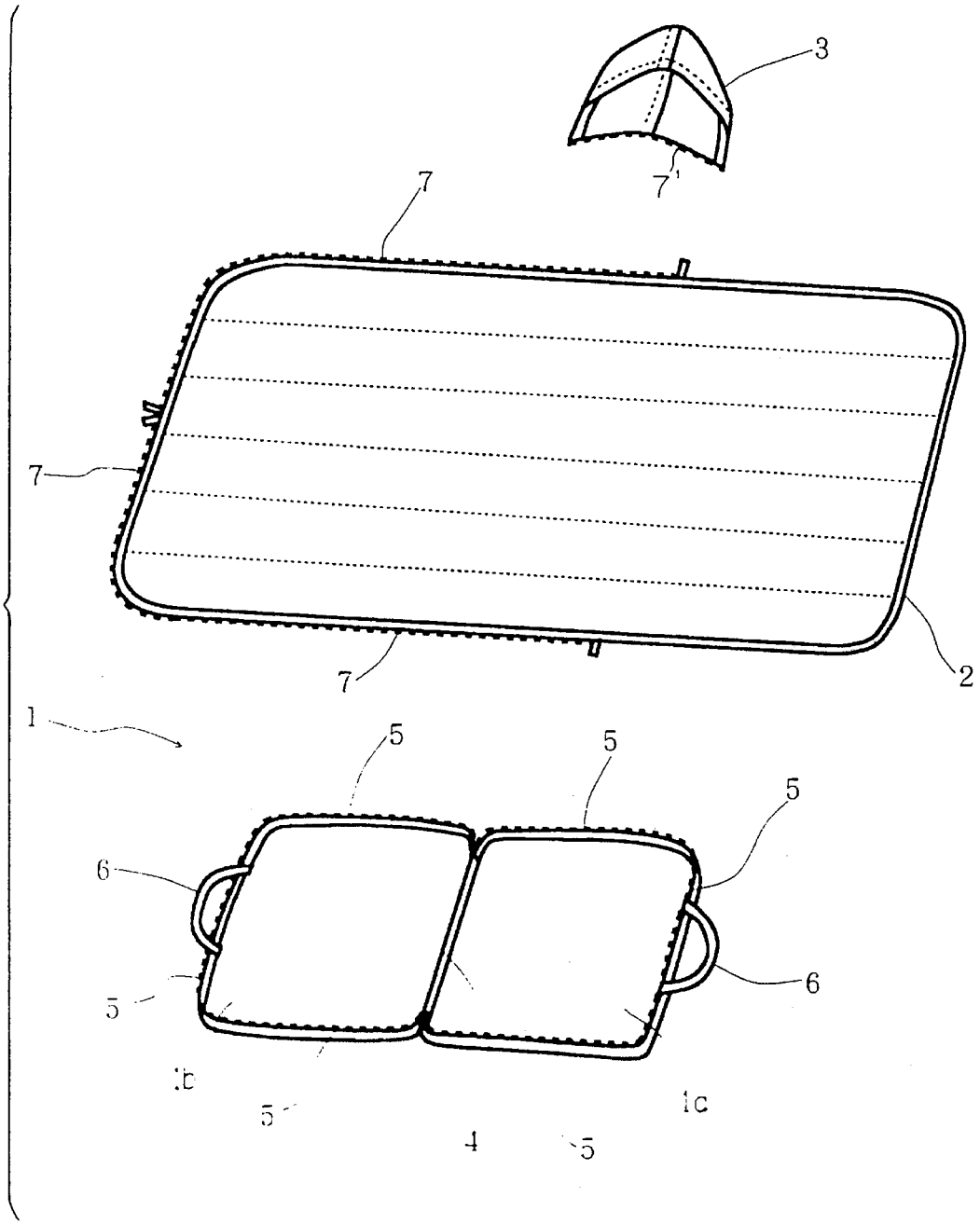
FIG. 1 is a perspective view of a multifunctional bag 1 according to a preferred embodiment of this invention, shown in an unfolded state, and a sheet 2 and a hood 3 to be contained in the bag 1.

A multifunctional bag device according to the present invention includes a bag 1 consisting of right and left bag members 1*a*, 1*b* and designed to contain appropriate things therein, and a single sheet 2 which is contained in a folded state in this bag 1. The bag 1 is equipped with a fastener 5 (such as the depicted zipper) or other opening/closing device at peripheral edges to allow the right and left bag members 1*a*, 1*b* of this bag to be unfolded, with the right and left members 1*a*, 1*b* being connected to each other at an appropriate one of the peripheral edges of the bag so that the right and left members of the bag can be separated from each other except at the one edge when unfolded. The sheet 2 is equipped with a fastener 7 (such as the illustrated zipper) or other opening/closing device at peripheral edges to allow a bag 8 to be formed by folding the single sheet 2 in half.

Figure 7:
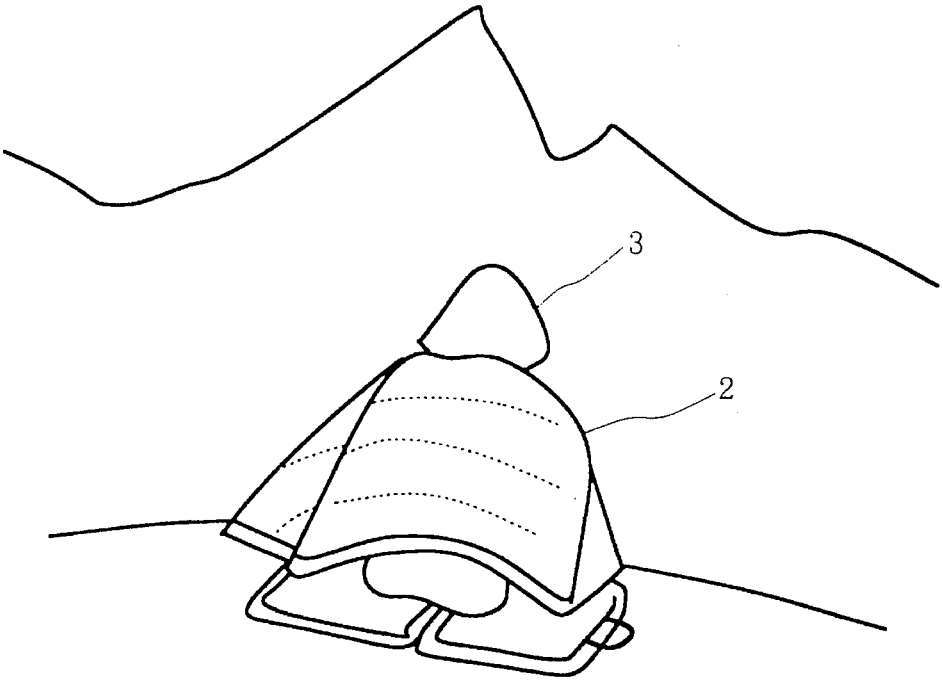
FIG. 7 is a perspective view of the bag 1 according to the preferred embodiment of this invention, in a state in which it is used as a hooded poncho.

The multifunctional bag device can also have a hood 3 provided in the bag 1 and formed so that it can be loaded on the upper portion of the sheet 2. That is, as shown in FIG. 1, the hood 3 is provided with a fastener 7' (such as the depicted zipper) fastening the hood 3 to the sheet 2 as shown in FIG. 7 via fasteners 7 and 7'.

Preferably, the bag 1 has handles 6 at the top edges of the respective bag members 1*a*, 1*b*, and edges of the bag members 1*a*, 1*b* are connected to each other at the bottom 4.

The multifunctional bag device of the present invention incorporates a heat insulation material in the sheet 2.

The function of each invention configured as stated above will be described here.

Figure 5:
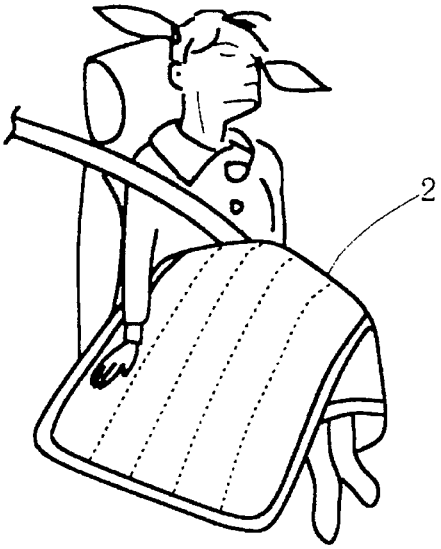
FIG. 5 is a perspective view of the bag 1 according to the preferred embodiment of this invention, in a state in which it is used as a lap robe.
Figure 6:
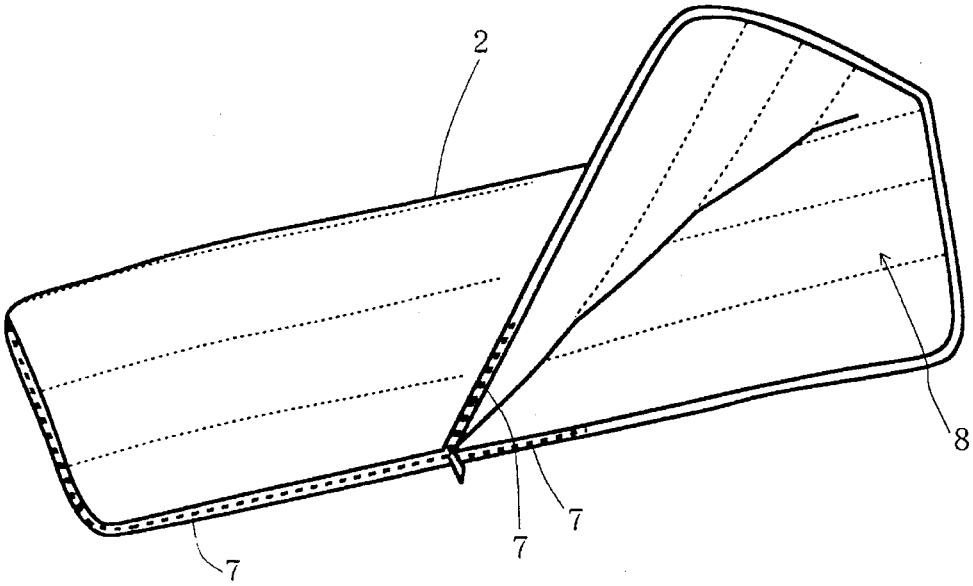
FIG. 6 is a perspective view of the bag 1 according to the preferred embodiment of this invention, in a state in which it is used as a sleeping bag.

The multifunctional bag device can be used not only as an ordinary bag, but also as a pair of seats by unfolding the right and left members of the bag or separating them from each other, and as a cushion by putting the handles 6 into the bag and closing the fastener 5 or other opening/closing device at peripheral edges of the bag. In addition, the sheet 2 can be removed from the bag 1 and used as a lap robe as shown in FIG. 5. By folding the sheet 2 removed from the bag 1 in half and using the fastener 7 or other opening/closing device at peripheral edges to form a bag, it can be used as a sleeping bag 8 (FIG. 6).

The multifunctional bag device can also be used as a hooded poncho (FIG. 7) by removing the sheet 2 and hood 3 from the bag 1 and loading the hood 3 on the upper portion of the sheet 2 via fasteners 7, 7'.

A heat insulation material is incorporated so that the sheet 2 can be used as a sleeping bag in the cold season.

The preferred embodiments of the multifunctional bag device according to this invention will now be described in detail with further reference to the drawings.

FIG. 1 shows a perspective view of the bag 1 in the unfolded state, as well as the sheet 2 and the hood 3 to be contained in the bag 1.

Figure 3:
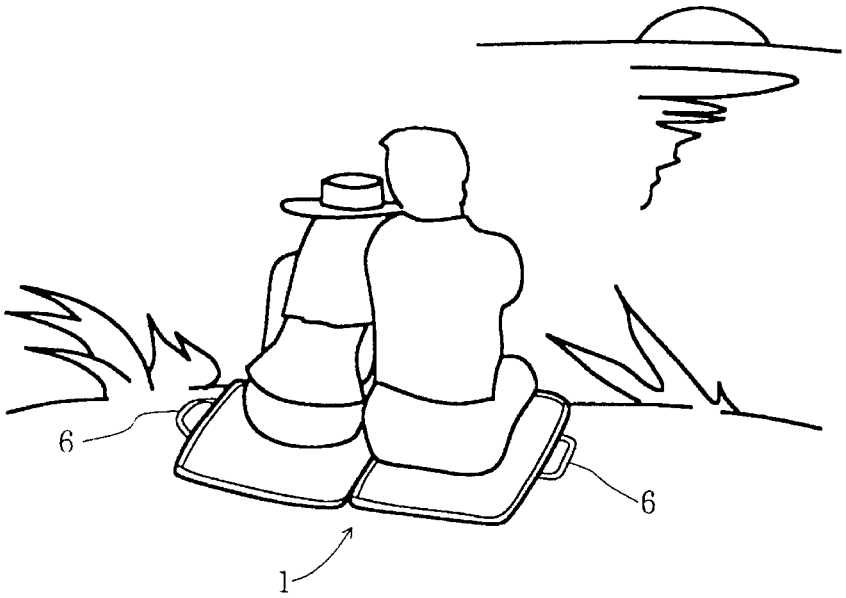
FIG. 3 is a perspective view of the bag 1 according to the preferred embodiment of this invention, in a state in which it is used as a pair of seats.

The bag 1 is preferably formed like a square bag as shown in FIGS. 1 and 3 with, for example, a water repellent material. The bag includes right and left handles 6 at the top. Edges of the right and left members 1*a*, 1*b* are connected to each other at the bottom 4. The peripheral edges on the three sides other than the bottom 4 are provided with a fastener 5 or other opening/closing device to allow the bag 1 to be unfolded as shown in FIG. 3. The bag 1 is designed to contain the sheet 2 and hood 3 in it. The sheet 2 and hood 3 are compactly folded before being inserted in the bag 1. The hood 3 is formed so that it can be loaded on the upper portion of the sheet 2 as shown in FIGS. 1 and 7 via the fasteners 7 and 7'.

In the preferred embodiment illustrated, edges of the right and left members are shown connected at the bottom 4 of the bag 1 such that the right and left members 1*a*, 1*b* are integrally connected to each other at the bottom 4 (to make the right and left members of the bag 1 inseparable from each other). However, in an alternative, a fastener or other device can be provided at the bottom 4, whereby the right and left members 1*a*, 1*b* of the bag 1 are connected to each other so that they can be separated from and reconnected to each other. Thus, when the right and left members of the bag 1 are connected to each other so that they can be separated from and reconnected to each other, by providing the edges of the right and left members at the bottom 4 with a fastener (not shown in the drawings) or other device, separation of the right and left members of the bag 1 from each other allows them to be used as two separate seats.

Further, although in the preferred embodiment illustrated, edges of the right and left bag members 1*a*, 1*b* are connected at the bottom 4 of the bag 1, the connection portion is not limited to the bottom 4. Rather, the right and left bag members 1*a*, 1*b* of the bag 1 can be connected to each other at an appropriate one of the peripheral edges of the bag 1 either so that they cannot be separated from each other or so that they can be separated from and reconnected to each other.

Further, although in the preferred embodiment illustrated, the bag 1 is formed like a square bag, the geometry of the bag 1 is not limited to that as shown in this preferred embodiment. A variety of bag geometries such as circular and semicircular ones can be utilized.

The sheet 2 is made of an appropriate natural fiber material or chemical fibrous material, etc., and peripheral edges of the sheet 2 are provided with the fastener 7 which allows the bag 8 as shown in FIG. 6 to be formed by folding the single sheet 2 as shown in FIG. 1 in half. The sheet 2 may incorporate an appropriate heat insulation material (not shown in the drawings) such as cotton rags.

Figure 2:
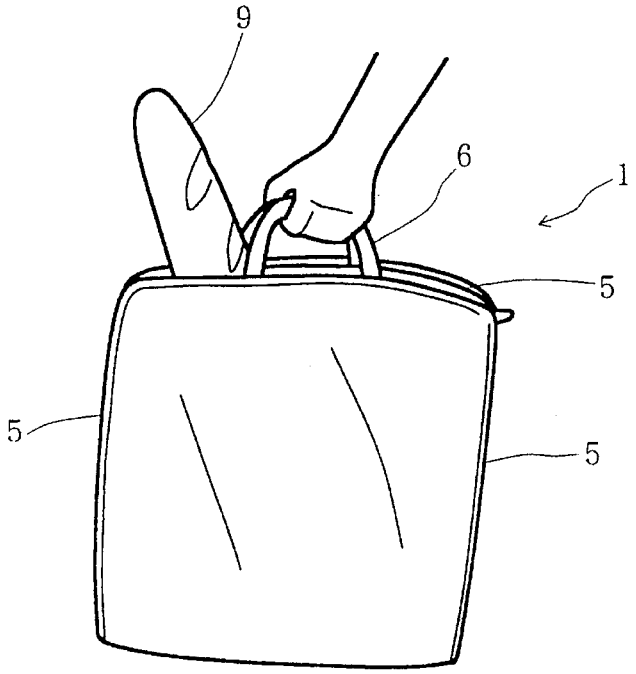
FIG. 2 is a perspective view of the bag 1 according to the preferred embodiment of this invention, in a state in which it is used as an ordinary bag.

The multifunctional bag device 1 thus configured has a style as shown in FIG. 2 when the sheet 2 and hood 3 are contained in the bag 1. In this case, the bag 1 can be used as an ordinary bag, containing an appropriate thing, such as a purchased loaf of bread 9 as shown in FIG. 2.

When the bag 1 is unfolded, it has a style as shown in FIG. 3. In this case, it can be used as a pair of seats.

Figure 4:
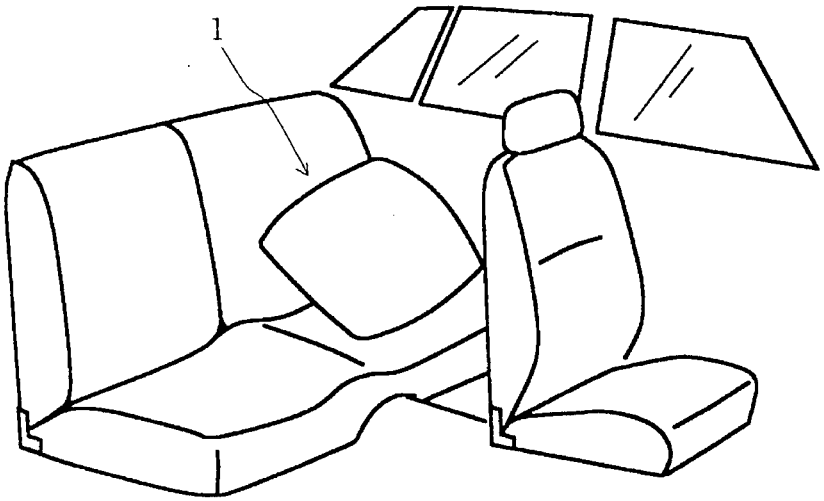
FIG. 4 is a perspective view of the bag 1 according to the preferred embodiment of this invention, in a state in which it is used as a cushion.

When the right and left handles 6 are put into the bag 1 and the peripheral fastener 5 on the three sides is closed, the bag 1 has a style as shown in FIG. 4. In this case, the bag 1 can be used as a cushion for use in various places.

When the sheet 2 is removed from the inside of the bag 1, it can be used as a lap robe as shown in FIG. 5. FIG. 5 shows the sheet 2 being used as a lap robe in an automobile.

The sheet 2 removed from the bag 1 can also be used as a sleeping bag. FIG. 6 shows this style. In addition, the sheet 2 can be used as a sleeping bag in the cold season when an appropriate heat insulation material such as cotton rags is incorporated in it.

When the sheet 2 and hood 3 are removed from the inside of the bag 1, and the hood 3 is loaded on the upper portion of the sheet 2, the combination can be used as a poncho as shown in FIG. 7.

Thus, this invention can provide a variety of functions with the sheet 2 and hood 3 contained in the inside of the bag 1. The multifunctional bag device 1 according to this invention is extremely convenient as an implement not only for use in hiking and other outdoor activities, but also for use in such activities as watching a soccer, baseball or other game.

This invention is not limited to the above-stated preferred embodiments, but permits various variants to be embodied within the scope of the claims. For example, as stated above, in the preferred embodiment, the bag 1 is formed like a square bag, the geometry of the bag 1 is not limited to that shown in the preferred embodiment. Further, in the preferred embodiment, the sheet 2 and hood 3 are contained in the inside of the bag 1. However, this invention may be embodied so that only the sheet 2 is contained in the inside of the bag 1 when it is unnecessary to use the sheet as a hooded poncho as shown in FIG. 7.

This invention described above in detail provides the following effects:

The multifunctional bag device 1 according to this invention can realize a novel bag that can be used not only as an ordinary bag, but also as a pair of seats, a cushion, a lap robe, a sleeping bag, and a hooded poncho.

What is claimed is:

1. A multifunctional bag device comprising:

a bag including first and second bag members, each of said first and second bag members including a hinge edge along a portion of a periphery thereof and fastener edges having fasteners thereon along other portions of the periphery, said first and second bag members being hinged together at their respective hinge edges and being detachably attached along their respective fastener edges by said fasteners, so that said bag is closable into a bag-shape for containing items therein by folding said first and second bag members toward one another about said hinge edges and fastening together the respective fastener edges of said first and second bag members with said fasteners, and so that said bag is openable to form a pair of seats by detaching the respective fastener edges from one another and unfolding said first and second bag members from one another along said hinge edges;

an elongate foldable sheet removably insertable in said bag when said bag is closed into said bag-shape and said sheet is folded, said sheet having fasteners provided along peripheral edges thereof for enabling said sheet to be formed into a sleeping bag by being folded along a longitudinal center and having said fasteners along the peripheral edges thereof fastened together so that one longitudinal end of the sleeping bag is closed by the fasteners, a first longitudinal side of the sleeping bag formed by folding along the longitudinal center of said sheet is closed and at least a portion of a second longitudinal side of said sleeping bag, opposite said first longitudinal side of said sleeping bag, is closed by the fasteners, said fasteners being unfastenable to allow said sheet to be unfolded for use as a lap robe or a body portion of a hooded poncho; and a hood removably insertable in said bag when said bag is closed into said bag-shape, said hood having a fastener provided along a bottom edge thereof for detachable attachment to a portion of one of the fasteners provided along the peripheral edges of said sheet, such that said hood and said sheet, when fastened together by the respective fasteners, form the hooded poncho.

2. A multifunctional bag device as recited in claim 1, further comprising a pair of handles respectively secured at ends of said first and second bag members opposite said hinge edges thereof.

3. A multifunctional bag device as recited in claim 1, wherein said hinge edges of said first and second bag members are permanently connected together.

4. A multifunctional bag device as recited in claim 1, wherein said hinge edges of said first and second bag members are detachably connected together.

5. A multifunctional bag device as recited in claim 1, further comprising a heat insulation material incorporated in said sheet.

6. A multifunctional bag device as recited in claim 1, wherein said fasteners provided on said bag, said sheet and said hood comprise zippers.

7. A multifunctional bag device as recited in claim 1, wherein for said elongate sheet, said fasteners are provided only along said one longitudinal end of said sheet and along a portion of each longitudinal side of said sheet adjacent said one longitudinal end, a second longitudinal end of said sheet opposite said one longitudinal end thereof being devoid of said fasteners, and a substantial portion of each of said longitudinal sides of said sheet adjacent said second longitudinal end thereof being devoid of said fasteners.

8. A multifunctional bag device as recited in claim 1, further comprising a pair of handles respectively secured at ends of said first and second bag members opposite said hinge edges thereof;

a heat insulation material incorporated in said sheet;

wherein said fasteners provided on said bag, said sheet and said hood comprise zippers; and wherein for said elongate sheet, said fasteners are provided only along said one longitudinal end of said sheet and along a portion of each longitudinal side of said sheet adjacent said one longitudinal end, a second longitudinal end of said sheet opposite said one longitudinal end thereof being devoid of said fasteners, and a substantial portion of each of said longitudinal sides of said sheet adjacent said second longitudinal end thereof being devoid of said fasteners.

9. A multifunctional bag device as recited in claim 8, wherein said hinge edges of said first and second bag members are permanently connected together.

10. A multifunctional bag device as recited in claim 8, wherein said hinge edges of said first and second bag members are detachably connected together.

* * * * *